US007028914B1

(12) United States Patent
Mair et al.

(10) Patent No.: US 7,028,914 B1
(45) Date of Patent: Apr. 18, 2006

(54) PIANO HUMIDISTAT

(75) Inventors: Robert W. Mair, Asheville, NC (US); E. Keith Howell, Hendersonville, NC (US)

(73) Assignee: Dampp-Chaser Electronics Corporation, Hendersonville, NC (US)

( * ) Notice: Subject to any disclaimer, the term of this patent is extended or adjusted under 35 U.S.C. 154(b) by 64 days.

(21) Appl. No.: 10/675,327

(22) Filed: Sep. 29, 2003

(51) Int. Cl.
*B01F 3/02* (2006.01)
*F25B 49/00* (2006.01)

(52) U.S. Cl. ..... 236/44 A; 236/44 E; 62/176.5

(58) Field of Classification Search ..... 236/44 A, 236/44 E, DIG. 13; 62/176.5; 237/78 R, 237/78 A; 219/494, 490
See application file for complete search history.

(56) References Cited

U.S. PATENT DOCUMENTS

| | | | | |
|---|---|---|---|---|
| 375,491 | A | 12/1887 | Ivers | |
| 1,033,536 | A | 7/1912 | Canfield | |
| 1,650,004 | A | 11/1927 | Billings | |
| 2,600,659 | A | 6/1952 | Koch, Jr. | |
| 3,304,066 | A | 2/1967 | Vieceli et al | |
| 3,339,578 | A | 9/1967 | Smith | |
| 3,580,158 | A | 5/1971 | Scholle et al | |
| 3,664,579 | A | 5/1972 | Foote | |
| 3,672,568 | A | 6/1972 | Foote | |
| 3,719,033 | A | 3/1973 | Den Boer | |
| 4,150,372 | A | 4/1979 | Foote | |
| 4,423,658 | A | 1/1984 | Foote | |
| 4,572,051 | A | 2/1986 | Laskin | |
| 4,649,793 | A | 3/1987 | Blackshear et al. | |
| 4,796,017 | A | 1/1989 | Merenda | |
| 4,987,408 | A | 1/1991 | Barron | |
| 5,230,466 | A * | 7/1993 | Moriya et al. | 236/44 A |
| 5,289,751 | A | 3/1994 | Light | |
| 5,428,347 | A | 6/1995 | Barron | |
| 5,428,348 | A | 6/1995 | Gault | |
| 5,456,742 | A | 10/1995 | Glenn et al. | |
| 5,625,345 | A | 4/1997 | Stark et al. | |
| 5,903,223 | A | 5/1999 | Howell | |
| 6,133,519 | A | 10/2000 | Mair | |

FOREIGN PATENT DOCUMENTS

GB 2214633 A * 9/1989

* cited by examiner

*Primary Examiner*—Chen Wen Jiang
(74) *Attorney, Agent, or Firm*—Carter Schnedler & Monteith, P.A.

(57) ABSTRACT

A humidistat including an air inlet defining a beginning of an airflow path through the humidistat, a humidity sensor for enabling measurement of the humidity of air flowing along the airflow path, a baffle, a heat source for heating air along a portion of the airflow path, the baffle and the heat source cooperating to define two zones in the humidistat, and an air outlet defining an end of the airflow path. During operation of the humidistat, the air temperature is higher in one zone than in the other zone, and the higher air temperature zone is downstream from the lower air temperature zone in the airflow path.

20 Claims, 3 Drawing Sheets

PIANO HUMIDISTAT

BACKGROUND OF THE INVENTION

This invention relates to an improved humidistat for regulating the humidity inside a piano.

Changes in relative humidity adversely affects pianos, particularly due to swelling and contraction of the piano soundboard. In geographical zones where humidity swings are substantial, such as, for example, between 20% and 75% relative humidity, pianos which do not have humidity control apparatus must be tuned often, e.g., every few weeks, in order for the pianos to perform properly. In addition, the swelling and contraction of the soundboard and other wood parts over time will result in a deterioration of the structural integrity of the entire piano. Thus it is desirable to maintain stable relative humidity inside the piano notwithstanding swings in relative humidity outside the piano. To accomplish this, readings of the relative humidity in very close proximity to the piano soundboard must be as accurate as possible.

Dampp-Chaser Electronics Corporation ("Dampp-Chaser"), assignee of the present invention, is the leading manufacturer of piano humidity control systems. Dampp-Chaser manufactures piano humidifiers, dehumidifiers, and humidistats which are used to control the relative humidity inside the piano. Examples of Dampp-Chaser's humidity control systems are set forth in its U.S. Pat. Nos. 4,150,372, 4,423,658, 5,903,223, and 6,133,519.

DETAILED DESCRIPTION OF THE INVENTION

Figure 1:
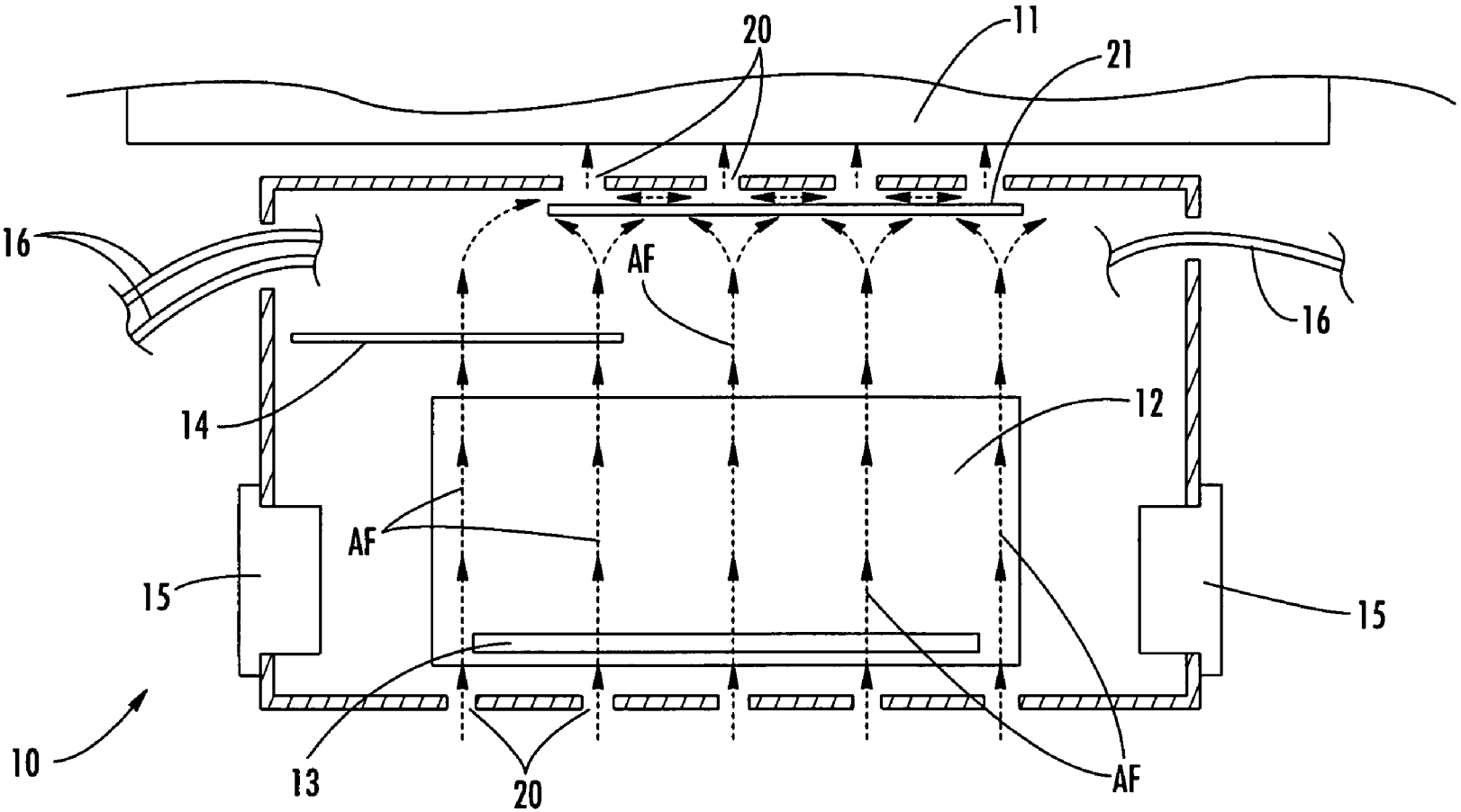
FIG. 1 (PRIOR ART)
FIG. 1 is a schematic diagram of a rear vertical cross-sectional view of a prior art piano humidistat shown in spatial relation to a soundboard of a grand piano.

A prior art piano humidistat manufactured by the assignee of the present invention, Dampp-Chaser Electronics Corporation, is shown broadly in FIG. 1 at reference numeral 10 in relation to a piano soundboard 11. The prior art humidistat 10 includes a humidity sensor housing 12, a humidity sensor 13 within the humidity sensor housing 12, a printed circuit board 14, electrical power outlets 15 for an associated dehumidifier and humidifier (not shown), and various power and utility cords 16. The prior art humidistat 10 also defines a plurality of openings 20 through which air may enter and exit the humidistat 10. In addition, a safety baffle 21 is situated in close proximity to the openings 20 in the humidistat 10 nearest the printed circuit board 14 in order to prevent a curious user from being shocked by inserting electrically conductive materials through the openings 20 nearest the printed circuit board 14 and contacting live electrical elements such as those that are powered on the printed circuit board 14 during humidistat 10 operation.

For optimal performance of a piano humidistat, the humidity sensor therein should continually be exposed to the air closest in proximity to the piano soundboard, as it is the relative humidity of this particular air that provides the most accurate measure of the relative humidity of the soundboard itself. Positive air flow from the area closest in proximity to the soundboard toward the humidity sensor of the humidistat is desired in order for the humidity sensor to be exposed to the most accurate representation of the current relative humidity of the air closest in proximity to the piano soundboard. Close proximity of the humidity sensor and the soundboard is desired for the same reason.

One method of bringing about positive air flow in a humidistat is through creation of a "chimney effect" within the humidistat. Such an effect may be created by defining two zones within the humidistat and causing a first zone to maintain a higher air temperature than a second zone during humidistat operation. However, in order to avoid the relative air temperature equalization that will naturally occur over time between the first and second zones, at least partial physical separation of the zones is required. In addition, the zones must be situated such that air flow between them is sufficiently constricted and directed between and within the zones to stimulate air flow from the lower air temperature zone into the higher air temperature zone. If these preconditions are met, during humidistat operation the lower temperature air will flow substantially downward through the lower air temperature zone toward the higher air temperature zone, where it will be heated. The heated air will be drawn further into the higher air temperature zone as it rises out of the humidistat. This air flow will cause a partial vacuum in the lower air temperature zone that will in turn be filled by air flowing into the lower air temperature zone from outside the humidistat. In this way, the desired positive air flow through the humidistat may be achieved.

Turning again to FIG. 1, the heat naturally generated by electrical circuitry (not shown) on the printed circuit board 14 during operation of the prior art humidistat 10 may be helpful toward achieving the desired chimney effect within the humidistat. However, the prior art humidistat 10 does not define zones having materially different air temperatures, and therefore the heat radiating from the electrical circuitry on the printed circuit board 14 during humidistat operation is spread and dissipated relatively evenly throughout the prior art humidistat 10, preventing any substantial positive air flow through the prior art humidistat 10. In any event, whatever positive air flow does occur within the prior art humidistat 10 as a result of the heat from the electrical circuitry on the printed circuit board 14 actually occurs in a direction opposite to the desired direction, that is, toward the soundboard 11 rather than away from the soundboard 11, as shown by arrows and dotted lines marked "AF" that indicate the airflow path. In addition, the humidity sensor 13 in the prior art humidistat 10 is physically separated from the soundboard 11 by the humidistat 10 itself.

Figure 2:
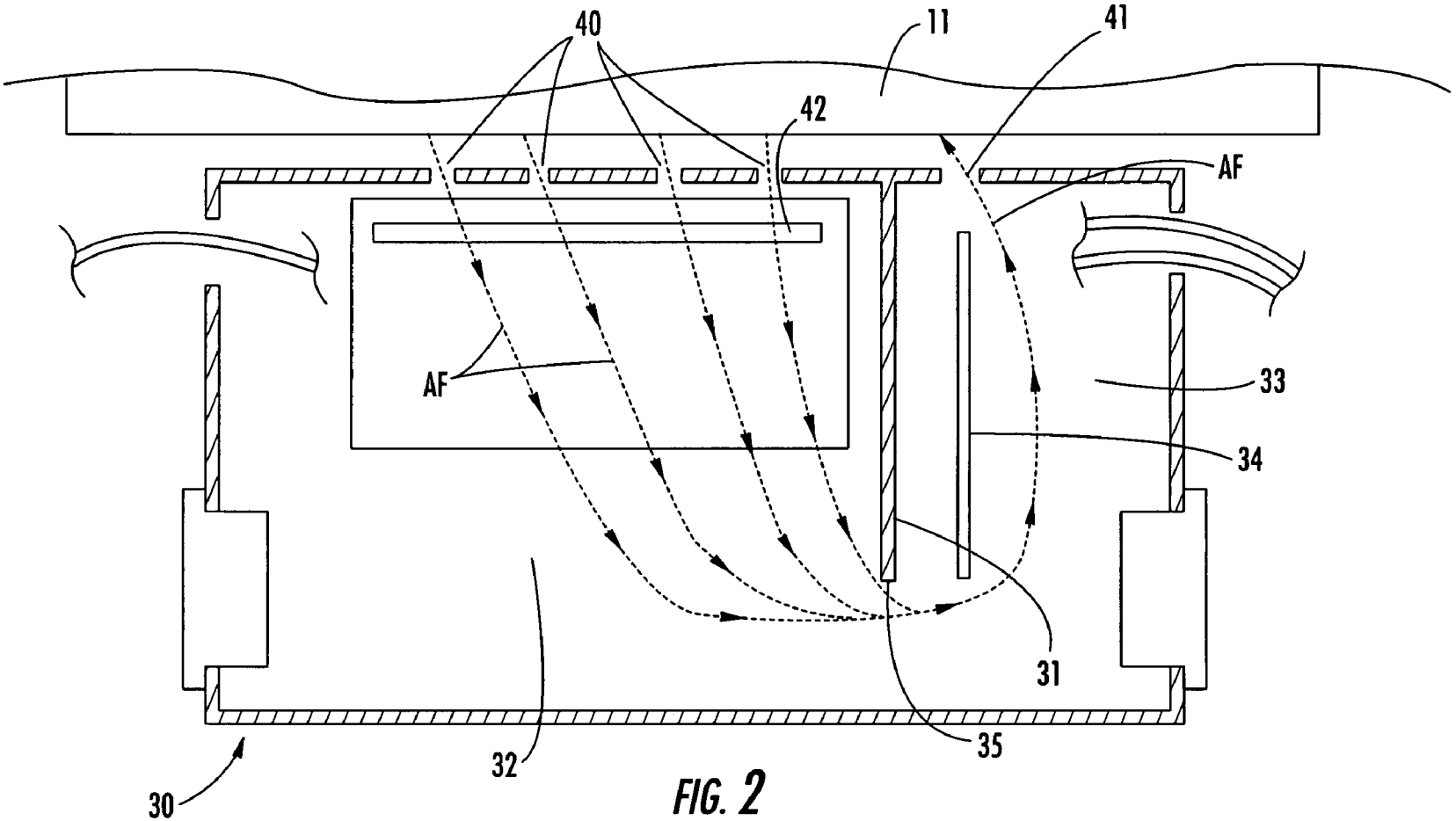
FIG. 2 is a schematic diagram of a rear vertical cross-sectional view of an improved piano humidistat according to an embodiment of the invention, shown in spatial relation to a soundboard of a grand piano.

Turning now to FIG. 2, an improved piano humidistat 30 in accordance with an embodiment of the invention is illustrated. This improved humidistat 30 is larger than the prior art humidistat 10 (FIG. 1) and better accomplishes the above objectives. A baffle 31 is included within the humidistat 30 to help define first and second zones 32, 33 within the humidistat. The baffle 31 could be oriented at any one of a variety of different angles and/or shaped as any one of a variety of different curves as long as air is able to flow from the first zone 32 into the second zone 33 during humidistat operation. Additionally, the baffle 31 could extend the full internal height of the humidistat and include openings to allow airflow through the baffle 31. It should be noted that a safety baffle such that shown in the prior art humidistat (FIG. 1 at 21) is unnecessary in the improved humidistat in light of the electrical components of the improved humidistat being oriented away from any openings into the humidistat.

During humidistat operation, electrical circuitry (not shown) on a printed circuit board 34 oriented in the second zone 33 heats the air in the humidistat such that the air temperature in the second zone 33 is generally higher than the air temperature in the first zone 32. Air enters the lower air temperature zone 32 through an air inlet 40 in the humidistat 30, and having a relatively low ambient temperature, falls substantially downward through the lower air temperature zone 32 as shown by arrows and dotted lines marked "AF" that indicate the airflow path through the humidistat. As it enters the humidistat 30, the air encounters and is sensed by the humidistat sensor 42, which therefore enables measurement of the relative humidity of the air in very close proximity to the piano soundboard 11, one of the desired results described above. As it continues to fall through the lower air temperature zone 32, the air nears an end 35 of the baffle 31, where it begins to be heated by heat that radiates from the electrical circuitry (not shown) on the printed circuit board 34 in the higher air temperature zone 33 when the printed circuit board 34 is electrically powered during humidistat 30 operation. As shown by the airflow path indicated with the arrows and dotted lines "AF", the heated air then begins to flow substantially upward toward the printed circuit board 34, where the air continues to increase in temperature and continues to flow substantially upward through the higher air temperature zone 33 before ultimately exiting the humidistat 30 through an air outlet 41 in the humidistat 30. This improved configuration provides the desired positive air flow ("AF") in the desired direction, namely, away from the soundboard 11.

Figure 3:
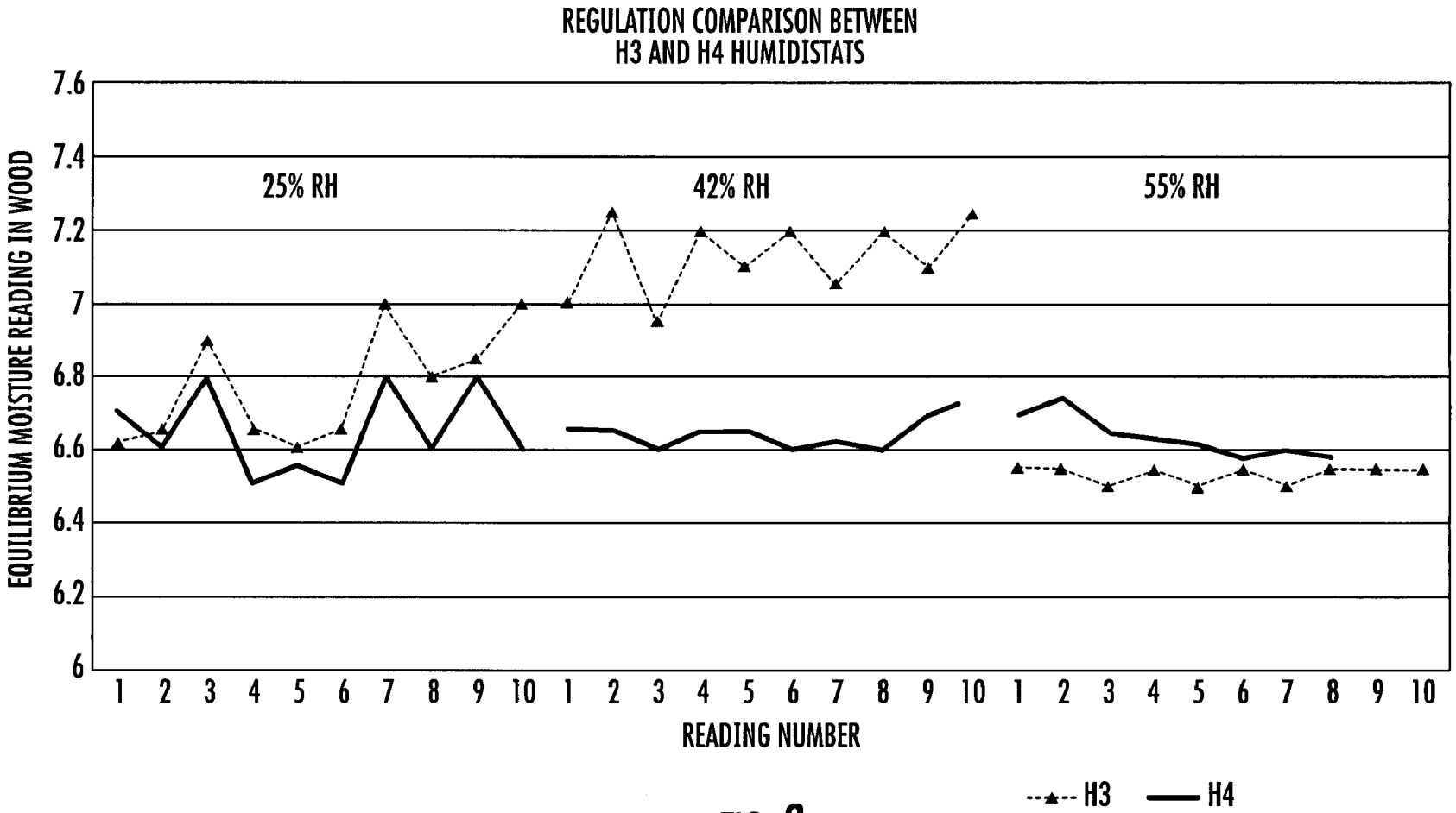
FIG. 3 is a line graph comparing the respective humidity control performances of the prior art piano humidistat shown in FIG. 1 and the improved piano humidistat shown in FIG. 2.

FIG. 3 shows a graph comparing the humidity regulation performance of the prior art humidistat 10 shown in FIG. 1 (noted as "H3" in the graph in conjunction with dotted lines with triangles thereon) and the improved humidistat 30 shown in FIG. 2 (noted as "H4" in the graph in conjunction with solid lines). For each of the two humidistats, ten readings (bottom scale of graph) of the equilibrium moisture of the soundboard (left-hand scale of graph) are shown for each of three relative humidities (noted within graph). Equilibrium soundboard moisture readings between approximately 6.6 and 6.8 are desired, as this range is consistent with those encountered in soundboards maintained in the storage facilities of most piano manufacturers. This equilibrium moisture range correlates to a range of approximately 42–46% relative air humidity around the soundboard. As can be seen from FIG. 3, the improved humidistat 30 ("H4," solid lines) maintains the equilibrium moisture of the soundboard in the desired 6.6 to 6.8 range far more consistently than the prior art humidistat 10 ("H3," dotted lines with triangles) across multiple readings and at varying relative air humidities.

An improved piano humidistat is described above. Various details of the invention may be changed without departing from its scope. Furthermore, the foregoing description of an embodiment of the invention and the best mode for practicing the invention are provided for the purpose of illustration only and not for the purpose of limitation—the invention being defined by the claims.

What is claimed is:

1. A humidistat comprising:

an air inlet defining a beginning of a fanless airflow path through the humidistat;

a humidity sensor for enabling measurement of the humidity of air flowing along the airflow path;

a baffle;

a heat source for heating air along a portion of the airflow path;

said baffle and said heat source cooperating to define two zones in the humidistat, wherein during operation of the humidistat, the air temperature is higher in one zone than in the other zone, and wherein the higher air temperature zone is downstream from the lower air temperature zone in the airflow path; and an air outlet defining an end of the airflow path.

2. A humidistat according to claim 1, wherein the humidistat is for regulating the humidity of a piano.

3. A humidistat according to claim 1, wherein when the humidistat is in use, air flowing along the airflow path enters the humidistat through the air inlet, flows substantially downward through the lower air temperature zone, is heated by the heat source, flows substantially upward through the higher air temperature zone, and exits the humidistat through the air outlet.

4. A humidistat according to claim 1, wherein the heat source is electrical circuitry for having electricity flowing therethrough.

5. A humidistat according to claim 4, wherein at least a portion of the electrical circuitry is mounted on a printed circuit board.

6. A humidistat according to claim 1, wherein the humidity sensor is oriented in the lower air temperature zone of the humidistat and upstream from the heat source in the airflow path.

7. A humidistat for regulating the humidity of a piano, comprising:

an air inlet defining a beginning of a fanless airflow path through the humidistat;

a humidity sensor for enabling measurement of the humidity of air flowing along the airflow path;

a baffle;

a heat source for heating air along a portion of the airflow path;

said baffle and said heat source cooperating to define two zones in the humidistat, wherein during operation of the humidistat, the air temperature is higher in one zone than in the other zone, and wherein the higher air temperature zone is downstream from the lower air temperature zone in the airflow path; and an air outlet defining an end of the airflow path.

8. A humidistat according to claim 7, wherein when the humidistat is in use, air flowing along the airflow path enters the humidistat through the air inlet, flows substantially downward through the lower air temperature zone, is heated by the heat source, flows substantially upward through the higher air temperature zone, and exits the humidistat through the air outlet.

9. A humidistat according to claim 7, wherein the heat source is electrical circuitry for having electricity flowing therethrough.

10. A humidistat according to claim 9, wherein the electrical circuitry is mounted on a printed circuit board.

11. A humidistat according to claim 7, wherein the humidity sensor is oriented in the lower air temperature zone of the humidistat and upstream from the heat source in the airflow path.

12. A humidistat for regulating the humidity of a piano, comprising:

an air inlet defining a beginning of a fanless airflow path through the humidistat;

a humidity sensor for enabling measurement of the humidity of air flowing along the airflow path;

a baffle;

electrical circuitry for having electricity flowing therethrough to heat air along a portion of the airflow path;

said baffle and said electrical circuitry cooperating to define two zones in the humidistat, wherein during operation of the humidistat, the air temperature is higher in one zone than in the other zone, and wherein the higher air temperature zone is downstream from the lower air temperature zone in the airflow path; and an air outlet defining an end of the airflow path;

wherein when the humidistat is in use, air flowing along the airflow path enters the humidistat through the air inlet, flows substantially downward through the lower air temperature zone, is heated by the electrical circuitry, flows substantially upward through the higher air temperature zone, and exits the humidistat through the air outlet.

13. A humidistat according to claim 12, wherein the electrical circuitry is mounted on a printed circuit board.

14. A humidistat according to claim 12, wherein the humidity sensor is oriented in the lower air temperature zone and upstream from the electrical circuitry in the airflow path.

15. A humidistat for regulating the humidity of a piano, comprising:

an air inlet defining a beginning of a fanless airflow path through the humidistat;

a humidity sensor for enabling measurement of the humidity of air flowing along the airflow path;

means for defining a lower air temperature zone and a higher air temperature zone along the airflow path, wherein the higher air temperature zone is downstream from the lower air temperature zone in the airflow path; and an air outlet defining an end of the airflow path.

16. A humidistat according to claim 15, wherein the defining means comprises a baffle cooperating with a heat source.

17. A humidistat according to claim 16, wherein the heat source is electrical circuitry for having electricity flowing therethrough.

18. A humidistat according to claim 17, wherein the electrical circuitry is mounted on a printed circuit board.

19. A humidistat according to claim 16, wherein when the humidistat is in use, air flowing along the airflow path enters the humidistat through the air inlet, flows substantially downward through the lower air temperature zone, is heated by the heat source, flows substantially upward through the higher air temperature zone, and exits the humidistat through the air outlet.

20. A method for regulating the humidity of a piano, said method comprising the steps of:

providing a humidistat comprising: an air inlet defining a beginning of a fanless airflow path through the humidistat; a humidity sensor for enabling measurement of the humidity of air flowing along the airflow path; a baffle; a heat source for heating air along a portion of the airflow path; said baffle and said heat source cooperating to define two zones in the humidistat, wherein during operation of the humidistat, the air temperature is higher in one zone than in the other zone, and wherein the higher air temperature zone is downstream from the lower air temperature zone in the airflow path; and an air outlet defining an end of the airflow path; and urging air along the airflow path such that air flowing along the airflow path enters the humidistat through the air inlet, flows substantially downward through the lower air temperature zone, is heated by the heat source, flows substantially upward through the higher air temperature zone, and exits the humidistat through the air outlet.

* * * * *